United States Patent [19]

Bashaw et al.

[11] 3,989,586

[45] Nov. 2, 1976

[54] ABSORBENT PAPER PRODUCTS AND METHOD OF PREPARATION

[75] Inventors: Robert N. Bashaw; Bobby L. Atkins; James R. Gross, all of Lake Jackson, Tex.

[73] Assignee: The Dow Chemical Company, Midland, Mich.

[22] Filed: Apr. 18, 1975

[21] Appl. No.: 569,433

Related U.S. Application Data

[63] Continuation-in-part of Ser. No. 359,589, May 11, 1973, abandoned.

[52] U.S. Cl. ..... 162/168 N; 162/183

[51] Int. Cl.[2] ..... D21D 3/00

[58] Field of Search ..... 162/168, 183, 184, 169, 162/168 R, 168 N; 260/78.5 R, 78.5 T

[56] References Cited

UNITED STATES PATENTS

| | | | |
|---|---|---|---|
| 2,647,886 | 8/1953 | Seymour | 260/78.5 R |
| 3,024,160 | 3/1962 | Kapral | 162/184 |
| 3,261,798 | 7/1966 | Farley | 162/168 R |
| 3,393,168 | 7/1968 | Johnson | 162/168 R |

*Primary Examiner*—S. Leon Bashore
*Assistant Examiner*—Peter Chin
*Attorney, Agent, or Firm*—Richard W. Hummer

[57] ABSTRACT

Lightly cross-linked, water-insoluble copolymers of maleic anhydride with suitable vinyl monomers are dispersed with the aid of a surfactant in a cellulosic pulp slurry or papermaking furnish to prepare molded pulp or paper products incorporating said copolymer in finely divided form. The resulting product is treated with an alkaline agent such as ammonia gas or an alcoholic solution of an alkali metal hydroxide to convert the copolymer to a water-swellable salt form whereby the treated molded pulp or paper product has a high absorbency for aqueous fluids.

10 Claims, No Drawings

ABSORBENT PAPER PRODUCTS AND METHOD OF PREPARATION

CROSS REFERENCE TO RELATED APPLICATION

This is a continuation-in-part of our copending application, Ser. No. 359,589, filed May 11, 1973 now abandoned.

BACKGROUND OF THE INVENTION

Water-soluble alkali metal and ammonium salts of copolymers of styrene or olefins with maleic anhydride have been known and used for a variety of purposes for many years. For example, Stump, in U.S. Pat. No. 3,451,890, teaches the use of small amounts of such water-soluble salts to produce improved rosin size compositions for incorporation in wet-laid paper. Farley, in U.S. Pat. No. 3,261,798, employed water-soluble salts of low-molecular-weight copolymers of maleic anhydride with olefins having 6 to 24 carbons to coat or impregnate preformed paper to improve brightness, ink reception and the like.

Alkali metal salts of cross-linked copolymers of styrene or olefins with maleic anhydride are also known and have been used particularly as efficient thickeners for aqueous compositions as shown, for example, by Seymour, U.S. Pat. No. 2,647,886 and Johnson, U.S. Pat. No. 3,393,168. Seymour considered his products to be water-soluble but subsequent studies have shown such cross-linked polymers to be, in fact, water-insoluble although, when lightly cross-linked, highly water-swellable and thus, as taught by Johnson, "forming a dilute gel or dispersion in aqueous medium."

Recently, in U.S. Pat. No. 3,669,103, it has been suggested that highly water-swellable, water-insoluble polymers be incorporated in paper to be used to increase the sorbency of sanitary articles. However, it has been found that the highly hydrophilic alkali metal or ammonium salts of cross-linked maleic anhydride copolymers, such as those taught by Seymour and Johnson, are totally unsuited for incorporation as such into a papermaking furnish since they render the furnish too viscous for proper running on the screens and in addition adversely affect the formation of the paper web and introduce severe drying problems.

It would therefore, be highly desirable, and is an object of the present invention, to have available a method whereby the cross-linked copolymers of styrene or olefins with maleic anhydride can be incorporated in a paper web in a form relatively inert to water and thereafter be converted to the highly water-swellable salt form.

SUMMARY OF THE INVENTION

In accordance with the present invention, there are provided novel sorptive paper products and a method for preparing cellulosic webs such as paper and paper board of greatly increased sorbency for water and other aqueous liquids. Similarly, there is provided a method for making molded pulp products having improved water sorbency. In the method of the invention, a lightly cross-linked, water-insoluble copolymer of maleic anhydride with a suitable vinyl monomer is incorporated in finely divided or fibrous form in the cellulosic web or molded pulp product and thereafter converted to a water-swellable polymeric form by treatment with a substantially anhydrous alkaline agent such as ammonia gas or an alcoholic solution of an alkali metal hydroxide. To obtain the desired distribution of the maleic anhydride copolymer in the cellulosic web or molded pulp product it is essential to employ a suitable surfactant to disperse said copolymer in the papermaking furnish or pulp suspension.

In carrying out the invention for the manufacture of paper or paper board, a copolymer of maleic anhydride with a suitable vinyl monomer, lightly cross-linked as hereinafter described, is dispersed in finely divided or fibrous form in an aqueous solution of a suitable surfactant and the resulting dispersion either is mixed with the suspension of cellulosic fibers constituting a papermaking furnish prior to the formation of a wet-laid cellulosic web from said furnish or the dispersion is filtered, dried and dry polymer mixed into the papermaking furnish. Good results have been obtained when employing from about 3 to about 25 percent, preferably from about 5 to 15 percent, of copolymer based on the weight of cellulose. It is among the advantages of the invention that the dispersion of maleic anhydride copolymer can be mixed with cellulosic pulp of standard consistency and fabricated in conventional machinery for the manufacture of paper, paper board or molded pulp products. The addition of the copolymer to a papermaking furnish can be made at any convenient point in the papermaking machinery circuit, for example, in the stock chest, at the fan pump or in conduits leading to the headbox, provided that sufficient mixing occurs following addition of the copolymer dispersion to provide a homogeneous mixture of pulp and copolymer before the furnish is fed to the screen or other web-forming device. Similarly, in the preparation of molded pulp products it is only necessary that the copolymer be thoroughly mixed with the pulp stock slurry before the latter is molded.

In practice, after incorporation of the maleic anhydride copolymer in the suspension of cellulosic pulp the resulting papermaking furnish is run onto a screen or suction roll to produce a wet-laid web of cellulosic fibers containing the copolymer. Similarly, pulp slurry is run into screen molds or the like to produce molded pulp products. The resulting paper or paper board web or molded pulp product is further processed in conventional fashion employing heating or the like for drying, followed by various conventional finishing steps depending upon the particular form and end use desired for the product. In any case, after the paper or molded pulp product has been dried sufficiently, it is submitted to treatment with an alkaline agent to convert the carboxylic anhydride moieties of the copolymer into an ammonium or alkali metal salt form whereby the lightly cross-linked copolymer, while remaining water-insoluble, becomes highly water-swellable.

The treatment with an alkaline agent can be carried out in any suitable fashion provided only that the resulting salt form of the copolymer is not prematurely exposed to an aqueous medium which would cause swelling of the water-swellable polymer so produced. In one mode of operation, the paper product containing the copolymer is introduced into a chamber and treated with ammonia gas under superatmospheric pressure. Alternatively, the paper product containing the copolymer is immersed in a solution of an alkali metal hydroxide in an anhydrous alcohol such as methanol or ethanol. In a further method of treatment the paper product containing the copolymer is first exposed to ammonia gas and then passed rapidly through an anhydrous alcoholic solution of an alkali metal hydroxide. Following treatment with ammonia, the product may be cured in a ventilated enclosure to remove excess ammonia gas. Similarly, following treatment with alcoholic alkali metal hydroxide solution, the product may be washed with anhydrous alcohol to remove excess alkali. Thereafter, the paper product containing the water-swellable salt form of the copolymer can be directly fabricated into absorbent articles or may be dried, if necessary, for storage or transportation in conventional fashion. If desired, the paper or molded pulp articles containing the cross-linked copolymer can be stored without treatment with an alkaline agent and then rendered highly sorptive by the above-described treatment with ammonia or alcoholic alkali immediately before use in or as a sorbent product.

While the applicants do not desire to be bound by any particular theory, it is believed that the above-described treatment with ammonia gas opens the carboxylic anhydride rings of the copolymer to convert one of the potential carboxyls thereof to an amide and the other to the ammonium salt form while treatment with alcoholic alkali metal hydroxide solution converts both potential carboxyls to alkali metal salts. Either of such products is herein referred to as a salt form of the copolymer. In view of the high reactivity of acid anhydrides with alkaline agents, the salt forming reaction take place readily and rapidly when the copolymer is contacted with the alkaline agent. Thus, with an alcoholic solution of alkali metal hydroxide it is only necessary to immerse the paper product containing said copolymer in said solution for a period of time sufficient for the solution to penetrate into the paper product and contact the particles or fibers of copolymer. Such immersion can be accomplished in conventional papermaking equipment, for example, by carrying the paper product on rollers through the alcoholic alkali solution contained in a tub sizing vat. When the alkaline agent is gaseous ammonia it is only necessary to provide sufficient time for the ammonia to diffuse into the paper and react with the copolymer. Such contact time will vary in known fashion depending on the thickness of the paper product and whether the product is treated in the form of sheets, rolls or other form. In any case, in practice the necessary time of treatment to convert the copolymer to the swellable salt form is readily predetermined on an initial small batch of the form of paper product to be treated.

Suitable copolymers include copolymers of maleic anhydride with olefins such as ethylene, propylene, butylene, isobutylene and the like or with a vinyl aromatic compound such as styrene. Such copolymers form by reaction of equimolar proportions of maleic anhydride with the vinyl monomer. Such copolymers are lightly cross-linked by incorporation of a polyunsaturated compound such as a divinyl or diallyl compound in the polymerization recipe. The copolymerization is carried out in known manner preferably in an inert solvent such as methylene chloride, benzene or acetone. Reaction is initiated by purging the reaction mixture of inhibitory oxygen and heating in the presence of a free radical initiator such as tertiary butyl hydroperoxide, tertiary butyl peroxypivalate, azobisisobutyronitrile or the like. Good results are obtained when employing from 1 to 1.1 moles of vinyl monomer and from 0.001 to 0.05 mole of cross-linking agent per mole of maleic anhydride in the reaction. Preferably, the cross-linking agent is employed in amount of from about 0.015 to about 0.02 mole per mole of maleic anhydride. In any case the proportion of cross-linker is chosen in predetermined amount to assure that the final salt form of the copolymer will be water-insoluble but highly water-swellable. In such operations in order to obtain a more uniform and efficient cross-linking reaction it is preferred to carry out the copolymerization and cross-linking reaction in a solvent such as acetone or methylethyl ketone wherein the product is obtained as a gel with such solvent. In any case the lightly cross-linked copolymer product is separated from the reaction solvent and comminuted and dried in conventional manners. In one mode of operation, the gel product, obtained when the copolymer is prepared in acetone as a solvent, is comminuted in a bath of methanol and the resulting finely divided copolymer is separated therefrom by filtration or decantation, washed with further methanol if desired and dried. Alternatively, the copolymers may be employed in the form of chopped fibers.

The polyunsaturated compounds employed as cross-linking agents in the bulk copolymerization process above may be any of various agents known in the art and containing two or more unconjugated sites of ethylenic unsaturation, such as divinylbenzene, diisopropenyl benzene, diallyl succinate, ethylene glycol diacrylate, diethylene glycol divinyl ether, allyl acrylate or an alkylidene-bisacrylamide such as N,N′-methylene bisacrylamide. The cross-linking agents are not equally effective with all vinyl monomers and it is preferred to employ divinylbenzene when styrene is the vinyl monomer and N,N′-methylene bisacrylamide when isobutylene or another aliphatic olefin is used.

Suitable surfactants may be any of various synthetic anionic, cationic or nonionic surface-active agents having a hydrophil-lipophil balance sufficiently high to accomplish rapid wetting and dispersion of the finely divided, hydrophobic copolymer in the paper furnish or pulp slurry without requiring so much surfactant as to generate foaming problems in the subsequent papermaking process. In general the surfactant is employed in the amount of from about 0.002 to about 5 percent by weight of the aqueous fluid in which the copolymer is dispersed prior to incorporation in the pulp furnish or slurry. Preferably the surfactant is used at the rate of about 0.002 to about 2 percent by weight of such fluid. For any specific surfactant and copolymer a simple jar test with a series of concentrations of surfactant can be employed to predetermine the minimum amount of surfactant required to obtain the desired wetting and dispersing of the copolymer. Suitable surfactants include (1) anionic agents, such as alkali metal salts of long chain alkyl sulfates, for example, sodium lauryl sulfate, alkali metal salts of alkylated aromatic sulfonates, such as sodium dodecylbenzene sulfonate or disodium dodecyl-diphenyl ether disulfonate and alkali metal salts of sulfosuccinate esters such as sodium dioctyl sulfosuccinate, (2) nonionic agents, such as alkanolamides of fatty acids, for example, coconut fatty acid diethanolamide, oxyethylene derivatives of sorbitan mono-aliphatic esters, for example, Tween 20, Tween 60 or Tween 80, and oxyethylene derivatives of alkylated phenols, such as the reaction product of nonylphenol with 9 to 10 molar proportions of ethylene oxide and (3) cationic agents such as lauryl pyridinium chloride, lauryl dimethylbenzylammonium chloride or cetyl dimethylamine oxide.

The following examples illustrate the invention but are not to be construed as limiting.

EXAMPLE 1

Forty-nine grams (0.5 mole) of maleic anhydride, 0.41 gram of azobisisobutyronitrile and 1.1 grams (0.0071 mole) of N,N'-methylenebisacrylamide were dissolved in 400 grams of acetone in an 800-milliliter stainless steel pressure vessel. The resulting solution was purged with nitrogen for 10 minutes and the vessel was then sealed. Thirty-one grams (0.55 mole) of isobutylene under pressure was valved into the reaction vessel and the latter was shaken to mix the contents and placed in a water bath maintained at 65° C for a period of 12 hours to copolymerize the monomers. Thereafter the vessel was cooled, vented and opened. The copolymer and acetone had formed a gel which was removed from the vessel and coagulated and dispersed in methanol in a blender. The copolymer product was separated by filtration, dried and pulverized in a high speed attrition mill until it was a finely divided, free-flowing powder.

Three-tenths gram of the powdered copolymer was dispersed in 20 milliliters of an aqueous 2 percent solution of sodium lauryl sulfate and the resulting dispersion added to a dispersion of 2.7 grams of unbleached kraft paper pulp in 200 milliliters of water. The resulting pulp slurry was employed in a standard laboratory handsheet apparatus following TAPPI Standard Method T-205 M-53 to produce a paper handsheet containing 10 percent by weight of the copolymer. The handsheet was dried in a hot press at 270° F and cut into 2-inch squares for further treatment and testing. The polymer-containing paper was placed in a pressure vessel at room temperature and submitted to the action of ammonia gas under a pressure of 40 pounds per square inch (gauge) for 3 hours. After venting and airing, a sample of the treated paper product weighing 0.46 gram was found to absorb 26.2 grams of deionized water. Thus, the paper product had an absorbency of 57 grams of water per gram. A second sample from the same batch showed an absorbency of 52 grams per gram. A further sample was found to have an absorbency of 12 for an aqueous 0.27N sodium chloride solution. Paper prepared in exactly similar fashion but without the polymer had an absorbency for deionized water of about 3.

EXAMPLE 2

Following the procedure of Example 1 a series of isobutylene-maleic anhydride copolymers were prepared with varying amounts of N,N'-methylenebisacrylamide (MBA) as cross-linker. Azobisisobutyronitrile in the amount of 0.5 to 1 percent by weight based on the weight of maleic anhydride was employed as the free radical initiator. Portions of each copolymer were employed for preparing paper handsheets containing 10 percent by weight of copolymer as in Example 1. The handsheets and other portions of the copolymers were treated with ammonia gas under pressure to convert the copolymers to the half-amide, half-ammonium salt form. Gel capacities, that is the grams of aqueous fluid absorbed per gram of copolymer salt, were determined for the copolymer salts in aqueous 0.27N sodium chloride solution and the absorbencies of the treated paper were determined in deionized water. The results are summarized in the following table wherein the cross-linker level is in terms of mole percent of MBA based on the amount of maleic anhydride employed.

| Cross-linker Level | Gel Capacity | Absorbency of Paper |
|---|---|---|
| 1.0 | 26 | 26 |
| 1.5 | 88 | 37 |
| 2.0 | 60 | 54 |
| 2.5 | 24 | 61 |

EXAMPLE 3

The cross-linked copolymer of Example 1 was incorporated by the method of Example 1 at various loadings in paper handsheets. The paper was dried, treated with ammonia and the absorbency for deionized water determined as in said Example. A paper handsheet without polymer was tested for water absorbency for comparison. The results are summarized in the following table.

| Percent of Polymer In Paper | Absorbency |
|---|---|
| 0 | 3.3 |
| 5 | 40.6 |
| 10 | 58.0 |
| 15 | 64.4 |

EXAMPLE 4

Citrate bottles of 350 milliliters capacity were employed as reaction vessels to prepare a series of copolymers of styrene and maleic anhydride cross-linked with divinylbenzene (DVB). Each bottle was charged with an acetone solution of 13 grams (0.125 mole) of styrene, 12.25 grams (0.125 mole) of maleic anhydride and 0.41 gram of azobisisobutyronitrile. Various measured amounts of a solution containing 2.168 grams of DVB per 100 milliliters of acetone were added as set forth in the following table. The resulting mixtures were purged with nitrogen for 10 minutes, the vessels were capped and the vessels and contents were heated at 60° C for 15.5 hours to carry out the polymerization. The copolymer products were isolated and dried as in Example 1 and the gel capacities for 0.27N sodium chloride solution determined as in Example 2. The results are summarized in the following table.

| Run No. | Diluent Acetone, ml. | DVB Solution, ml. | Gel Capacity, g./g. |
|---|---|---|---|
| 1 | 140 | 5 | 29 |
| 2 | 135 | 10 | 34 |
| 3 | 120 | 25 | 19 |

EXAMPLE 5

Portions of the copolymer from Run No. 2 of Example 4 were dispersed in an aqeuous solution of anionic surfactant and added to cellulose slurry employed for the preparation of paper handsheets by the procedure of Example 1. The resulting paper products were tested for absorbency after treatment with ammonia gas to convert the copolymer to the ammonium salt form. The results are summarized in the following table.

| Percent of Polymer In Paper | Absorbency for Deionized Water, g./g. |
|---|---|
| 12 | 73.5 |
| 25 | 78.8 |

Similar good results are obtained when the lightly cross-linked copolymers are dispersed in papermaking slurries with the aid of an aqueous 0.25 percent by weight solution of sodium dodecylbenzenesulfonate or an aqueous 0.3 percent solution of sodium dodecyldiphenyl ether disulfonate. Paper products prepared from such slurries and containing from 5 to 15 percent by weight of copolymer are immersed in a solution of 5 percent of sodium hydroxide in anhydrous methanol to convert the copolymer to the sodium salt form. The products, after washing in methanol and drying, are found to have high absorbency for aqueous fluids.

We claim:

1. A method for producing a sorptive paper product containing a water-insoluble, water-swellable copolymer which comprises the steps of forming a dispersion of a finely divided copolymer of maleic anhydride with styrene, ethylene, propylene, butylene or isobutylene, cross-linked with from about 0.001 to about 0.05 mole of a polyunsaturated cross-linking agent per mole of maleic anhydride in the copolymer, in an aqueous solution of a synthetic surfactant, incorporating said dispersion in an aqueous suspension of cellulosic pulp to provide from about 3 to about 25 percent by weight of said copolymer based on the weight of cellulosic material in the suspension, forming a paper product from the resulting mixed suspension, drying said product and exposing the dried product to the action of ammonia or an alcoholic solution of an alkali metal hydroxide for a predetermined period to convert the copolymer to the water-swellable salt form.

2. The method of claim 1 wherein the copolymer consists of substantially equimolar proportions of styrene and maleic anhydride.

3. The method of claim 2 wherein the cross-linking agent is divinylbenzene.

4. The method of claim 3 wherein the paper product is exposed to the action of ammonia to convert the copolymer to the ammonium salt form.

5. The method of claim 3 wherein the paper product is exposed to the action of alcoholic sodium hydroxide solution to convert the copolymer to the sodium salt form.

6. The method of claim 1 wherein the copolymer consists of substantially equimolar proportions of isobutylene and maleic anhydride.

7. The method of claim 6 wherein the cross-linking agent is N,N′-methylenebisacrylamide.

8. The method of claim 7 wherein the paper product is exposed to the action of ammonia to convert the copolymer to the ammonium salt form.

9. The method of claim 7 wherein the paper product is exposed to the action of alcoholic sodium hydroxide solution to convert the copolymer to the sodium salt form.

10. A sorptive paper product prepared by the method of claim 1.

* * * * *